US011530619B1

(12) United States Patent
Gohel et al.

(10) Patent No.: US 11,530,619 B1
(45) Date of Patent: Dec. 20, 2022

(54) SYSTEM AND METHOD FOR AUTOMATIC DETECTION OF UNINTENDED FORWARD AND REVERSE ROTATIONS IN ROTATING EQUIPMENT

(71) Applicant: SAUDI ARABIAN OIL COMPANY, Dhahran (SA)

(72) Inventors: Kinjalkumar P. Gohel, Ras Tanura (SA); Mahmoud N. Mahmoud, Ras Tanura (SA); Mohammed M. Alharbi, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/496,932

(22) Filed: Oct. 8, 2021

(51) Int. Cl.
*F02D 41/04* (2006.01)
*F01D 21/00* (2006.01)

(52) U.S. Cl.
CPC ..... *F01D 21/003* (2013.01); *F02D 41/04* (2013.01); *F02D 2250/06* (2013.01)

(58) Field of Classification Search
CPC ..... F01D 21/003; F02D 41/04; F02D 2250/06
USPC ..... 123/565, 436; 701/107, 110
See application file for complete search history.

(56) References Cited

U.S. PATENT DOCUMENTS

| | | | |
|---|---|---|---|
| 5,649,808 | A | 7/1997 | Gruszecki et al. |
| 7,300,257 | B2 | 11/2007 | Lifson et al. |
| 10,371,072 | B2 | 8/2019 | Gouzenne Coutier |
| 2010/0241302 | A1 | 9/2010 | Shimizu |
| 2016/0076394 | A1 | 3/2016 | Maalouf et al. |

FOREIGN PATENT DOCUMENTS

WO 2016165829 A1 10/2016

*Primary Examiner* — Hai H Huynh
(74) *Attorney, Agent, or Firm* — Osha Bergman Watanabe & Burton LLP

(57) ABSTRACT

A system includes one or more sensors to detect unintended forward and reverse rotation of rotating machinery. The system also includes a monitoring system consisting of a processor, memory, display and communication interface. The processor receives signals from the sensors. The processor determines unintended rotation when the pattern of received signals match with the conditions defined in the processor. The processor generates a notification signal of "Unintended Rotation" on the display. The notification signal is also sent to the operator workstation to alert the operating personnel. The notification history is also stored in the system memory. The system is also configured to initiate automatic action to stop the unintended rotation and protect the machinery components from unintended rotation. The action may include closing the suction and discharge valve and starting the lubrication system to lube the bearings of the rotating machinery and the motor.

10 Claims, 3 Drawing Sheets

SYSTEM AND METHOD FOR AUTOMATIC DETECTION OF UNINTENDED FORWARD AND REVERSE ROTATIONS IN ROTATING EQUIPMENT

FIELD OF THE DISCLOSURE

Embodiments disclosed herein relate generally to the rotating machinery monitoring system. More specifically, embodiments disclosed herein relate to automatic detection of unintended rotation either in forward or in reverse direction.

BACKGROUND

Rotating machinery may be a pump, fan, turbine, or compressor where the energy transfer takes place between the rotor to the fluid, which may be liquid or gas, by the action of rotation. with at least one rotating component that transfers energy. In case of a pump, the energy is transferred from the rotor to the fluid. In case of a fan or a compressor, the energy is transferred from rotor to the gaseous fluid. In a turbine, the energy of the fluid is transferred to the rotor.

Rotating machinery is used in wide variety of industries (e.g., oil and gas, manufacturing, power generation, automobiles) from small appliances to large heavy industrial applications. With the wide variety of industries using the rotating machinery, condition monitoring plays an important role in operational sustainability. The use of rotating machinery requires planning, coordination, and equipment monitoring of health and performance. Safety is always a concern in the field, and it begins with a thorough understanding of machinery design, interactions with the process fluid and operational constraints. Rotating machines are designed to operate in a unique direction. However, internal leakage or malfunction in operation of valves may lead to unintended machine rotation in forward or reverse direction during the period it is expected that the rotating machinery does not rotate (i.e., remain in standstill condition). Unintended rotation in any direction, if left unchecked, can lead to serious safety and reliability incidents such as loss of process fluid containment due to mechanical seal failure or major damage to the bearings and rotor failure resulting in extended outage and high repair costs.

Conventional methods are dependent on workers being present to oversee and conduct operations using the rotating machinery. However, operators' attention is generally focused and there is high probability that unintended rotation of stopped equipment goes unnoticed. Some scenarios of unintended equipment rotation are described. The stopped machine would rotate in reverse direction in case the discharge shut-off valve is open or leaking internally as well as the check valve is also leaking internally. High pressure fluid from the discharge header passes through the machine towards low pressure suction header through open suction valve causing reverse rotation. In other situations, the machine would rotate in forward direction, if its discharge pipe is open to low pressure area (usually flare header) and the suction valve leaks internally or opens due to any malfunction.

SUMMARY OF DISCLOSURE

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, the embodiments disclosed herein relate to a system that includes a sensor for continuous monitoring of rotating machinery and generate a signal of rotational speed or vibration, another sensor to generate ON/OFF indication signal based on status of connection and disconnection of power or motive fluid supply to the driver, communication interface with the monitoring system and the processer built into the monitoring system to receive signals from the sensors and compare the signal to predetermined operating conditions to generate alert notification of "unintended rotation" upon simultaneous occurrence of a specific combination of the signals from the aforementioned sensors.

In another aspect, the embodiments disclosed herein relate to a computer algorithm stored in the memory of the monitoring system consisting of codes to receive signal from the speed or vibration sensor on the machine and status indication signal from the driver via the communication interface, and determine the "unintended rotation" by comparing the signal inputs with a set of defined conditions.

In yet another aspect, the embodiments disclosed herein relate to a machine condition monitoring system consisting of a set of sensors to provide machine speed or vibration as well as the status indication of the driver, a communication interface, a processor receiving signals from the sensors to determine to occurrence of "unintended rotation" and generate notification signal to be displayed on the system display and communicated to operator workstation as well as stored in the memory to for review and analysis purposes. The notification signal may also be utilized for automatic initiation of corrective actions. For instance, starting the lubrication system to protect the bearings.

In one aspect, the embodiments disclosed herein relate to a method. The method may include placing, with a controller, a rotary machinery in a standby mode, wherein the standby mode turns off the rotary machinery; and reducing, with the controller, a speed of at least one rotating component of the rotary machinery to zero rotations per minute. The method may also include continuously monitoring inputs from sensors on the rotary machinery, the continuously monitoring includes transmitting to the controller a first input from a status indicator sensor based on a mode of the rotary machinery; and transmitting to the controller a second input from a speed sensor based on the speed of the at least one rotating component. The method may further include sending, with the controller, alerts to a human machine interface based the first input and the second input.

In another aspect, the embodiments disclosed herein relate to a system. The system may include a rotary machinery, the rotary machinery includes at least one rotating component; at least one valve; a standby mode wherein the at least one rotating component has a rotation speed of zero; and a running mode wherein the at least one rotating component has the rotation speed of great than zero. The system may also include one or more sensors disposed on or within the rotary machinery, the one or more sensors are configured to collect data on the rotary machinery, and the collect data includes a first input monitoring a rotation speed of the at least one rotating component and a second input monitoring a mode of the rotary machinery. The system may further include a computing system having a controller in communication with the one or more sensors, the computing system is configured to receive the collected data from the one or more sensors; and instructions provided on a software application of the computing system. The instructions may include a sequence of operations for the controller to send alerts to a human machine interface of the computing system and to send commands to the rotary machinery.

Other aspects and advantages will be apparent from the following description and the appended claims.

DETAILED DESCRIPTION

Figure 1:
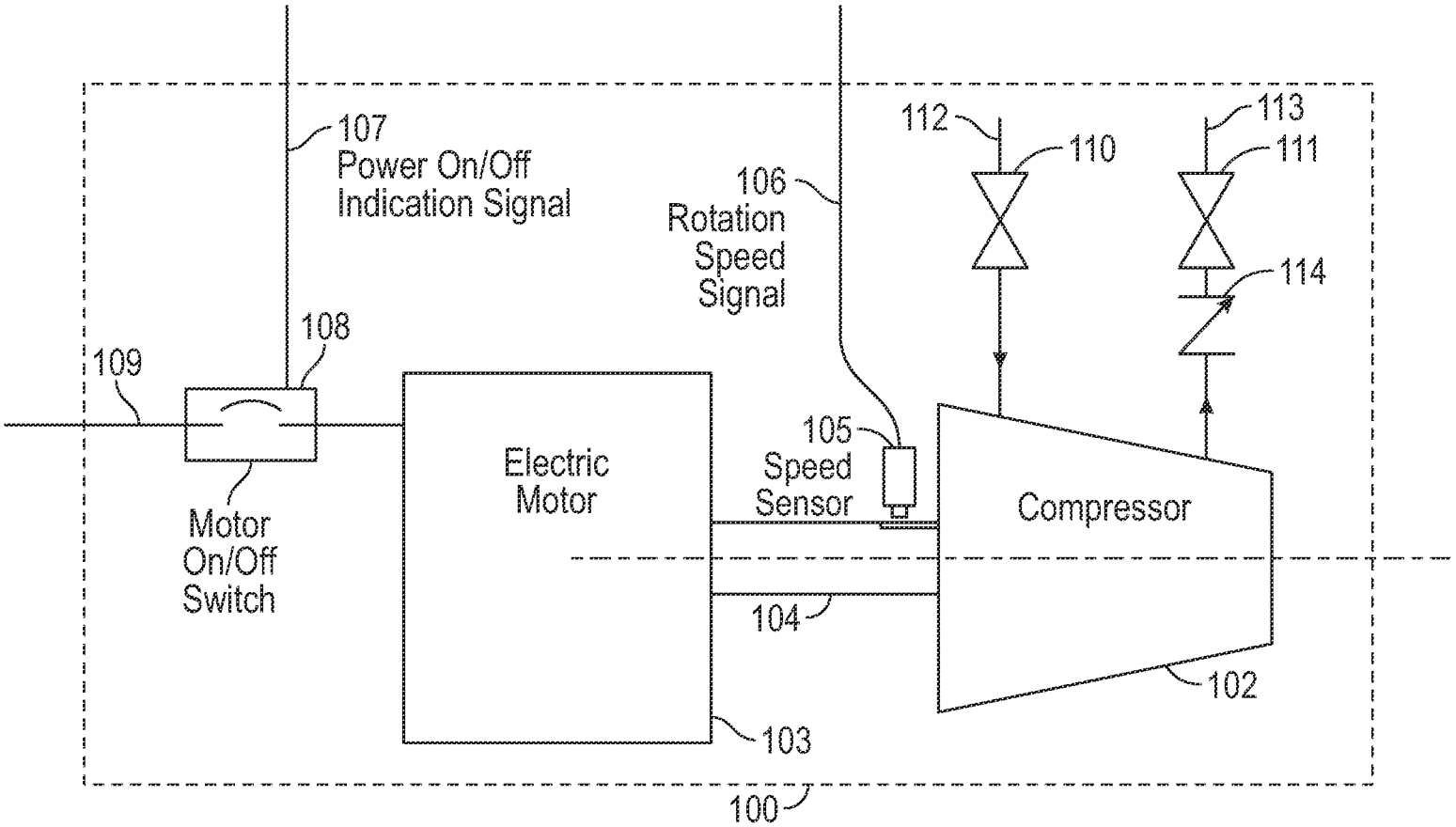
FIG. 1 illustrates a schematic view of a rotating machinery according to one or more embodiments of the present disclosure.

Embodiments of the present disclosure are described below in detail with reference to the accompanying figures. Wherever possible, like or identical reference numerals are used in the figures to identify common or the same elements. The figures are not necessarily to scale and certain features and certain views of the figures may be shown exaggerated in scale for purposes of clarification. Further, in the following detailed description, numerous specific details are set forth in order to provide a more thorough understanding of the claimed subject matter. However, it will be apparent to one having ordinary skill in the art that the embodiments described may be practiced without these specific details. In other instances, well-known features have not been described in detail to avoid unnecessarily complicating the description. As used herein, the term "coupled" or "coupled to" or "connected" or "connected to" may indicate establishing either a direct or indirect connection, and is not limited to either unless expressly referenced as such. The embodiments are described merely as examples of useful applications, which are not limited to any specific details of the embodiments herein.

In operation, a rotating machinery is disposed at a work site to perform a wide variety of operations such as pumping fluids, converting power into potential energy stored in pressurized air, and other rotating machinery operations. The rotating machinery encompasses a number of components such as at least one rotating component that is durable, sensitive, complex, simple components, or any combination thereof. Furthermore, it is also understood that one or more of the at least one rotating component may be interdependent upon other components in the rotating machinery.

Conventional monitoring systems typically require workers on site to ensure proper operations of the rotating machinery. For example, an operator may be on site to visually monitor the rotating machinery is operated properly and the at least one rotating component of the rotating machinery is not unnecessarily rotated. Additionally, various components of the rotating machinery may not be exposed for visual monitoring. As a result, conventional monitoring systems are prone to human errors resulting in delays in detecting unintended rotation of the at least one rotating component, expensive damage, and non-productive time (NPT). In addition, there is automated log and alerts on operational information as conventional monitoring systems are monitored by workers. As such, conventional monitoring systems may fail to have real-time information on how long an activity lasted/duration (e.g., how long the at least one rotating component rotated or when the at least one rotating component started rotated) to determine maintenance requirements or service requirements.

One or more embodiments in the present disclosure may be used to overcome such challenges as well as provide additional advantages over conventional monitoring systems of the rotating machinery. For example, in some embodiments, an automated monitoring system including a computing system described herein and one or more sensors working in conjunction with the rotating machinery may streamline and improve efficiency as compared with conventional monitoring systems due, in part, to reducing or eliminating human interaction with the rotating machinery by automating operations, monitoring, logging, and alerts.

In one aspect, embodiments disclosed herein relate to continuous automatized monitoring system that may perform multiple processes for a rotating machinery. The continuous automatized monitoring system may be used, for example, to monitor inputs from one or more sensors of the rotating machinery, detect unintended rotation in the rotating machinery, generating alerts based on a status of the rotating machinery, starting operations of the rotating machinery. Further, continuous automatized monitoring system may be used to identify defective components of the rotating machinery. Automating a continuous monitoring system for a rotating machinery according to one or more embodiments described herein may provide a cost-effective alternative to conventional monitoring system. The embodiments are described merely as examples of useful applications, which are not limited to any specific details of the embodiments herein.

Referring now to FIG. 1, a system (100) having a rotating machinery (102) is illustrated according to embodiments of the present disclosure. For example, the rotating machinery (102) may be a gas compressor. While it is noted that the rotating machinery (102) is shown as a gas compressor, this is for example purposes only and the rotating machinery (102) may be any rotating machinery such as a pump, fan, turbine, or a motor without departing from the scope of the present invention. The rotating machinery (102) may include a suction valve (110), a discharge valve (111) and discharge check valve (114) to control the flow of gas into and out of the compressor. Flow lines (112, 113) may be attached to the suction valve (110) and the discharge valve (111) for fluids to flow in and out of the rotating machinery (102), respectively. The motor (103) drives the compressor. While it is noted that the motor (103) is shown as electrical powered, it may be gas, diesel, or steam powered.

In one or more embodiments, the rotating machinery (102) has a standby mode where the rotating machinery (102) is off or in an idle mode where the rotating machinery (102) is one without being operated or a running mode where the rotating machinery (102) is being operated. In operation, when the rotating machinery (102) is turned on from the standby mode, the motor (103) is powered such that the rotor (104) rotates.

Still referring to FIG. 1, a sensor (105) monitoring the speed of the rotor (104) is coupled to the rotating machinery (102). The sensor (105) may transmit the speed of the rotor (104) as a rotational speed signal (106) to a continuous automatized monitoring system (see FIG. 2). Another sensor (108) continuously monitors the ON/OFF status (109) of the power supply to motor (103). The sensor (108) may transmit the ON/OFF status (109) of the power supply to motor (103) as a power ON/OFF indication signal (107) to the continuous automatized monitoring system (see FIG. 2). While it is noted that two sensors are shown, this is for example purposes only, and any number of sensors may be used without departing from the scope of the present disclosure.

In one or more embodiments, the one or more sensors (105, 108) may be a microphone, ultrasonic, ultrasound, sound navigation and ranging (SONAR), radio detection and ranging (RADAR), proximity sensing, acoustic, piezoelectric, accelerometers, temperature, pressure, weight, position, or any sensor in the art to detect and monitor the plurality of devices. In one or more embodiments, data acquisition hardware is incorporated into the one or more sensors (105, 108). The one or more sensors (105, 108) may be disposed on the rotating machinery (102) and the motor (103) at work site and/or during the manufacturing of the rotating machinery (102) and the motor (103). It is further envisioned that the one or more sensors (105, 108) may be provided inside a component of the rotating machinery (102) and the motor (103).

The one or more sensors (105, 108) may be used to collect data on status, process conditions, performance, and overall quality of the various components of the rotating machinery (102) and the motor (103) that said sensors are monitoring, for example, on/off status of the motor (103) and speed of the rotating machinery (102). One skilled in the art will appreciate the one or more sensors (105, 108) may aid in detecting unintended rotation of the rotating machinery (102) and the possible failure mechanisms in individual components, approaching maintenance or service, and/or compliance issues. In one or more embodiments, the one or more sensors (105, 108) may transmit and receive information/instructions to the continuous automatized monitoring system illustrated in FIG. 2, wirelessly and/or through wires attached thereof. In a non-limiting example, each sensor of the one or more sensors (105, 108) may have an antenna (not shown) to be in communication with an antenna (not shown) of the continuous automatized monitoring system (see FIG. 2). It is further envisioned that the one or more sensors (105, 108) may transmit and receive information/instructions to the continuous automatized monitoring system (see FIG. 2) at a remote location away from the rotating machinery (102).

In one aspect, the one or more sensors (105) may be used to record and monitor speed or vibration of the rotating machinery (102) In one or more examples, the one or more sensors (108) may provide information such as a current state of the rotating machinery (102) (i.e., standby mode, or running mode). By obtaining such information, the continuous automatized monitoring system (see FIG. 2) may form an independent control system for rotating machinery control and monitoring eliminating the need of visual inspection and reducing or eliminating human interaction rotating equipment operation.

Figure 2:
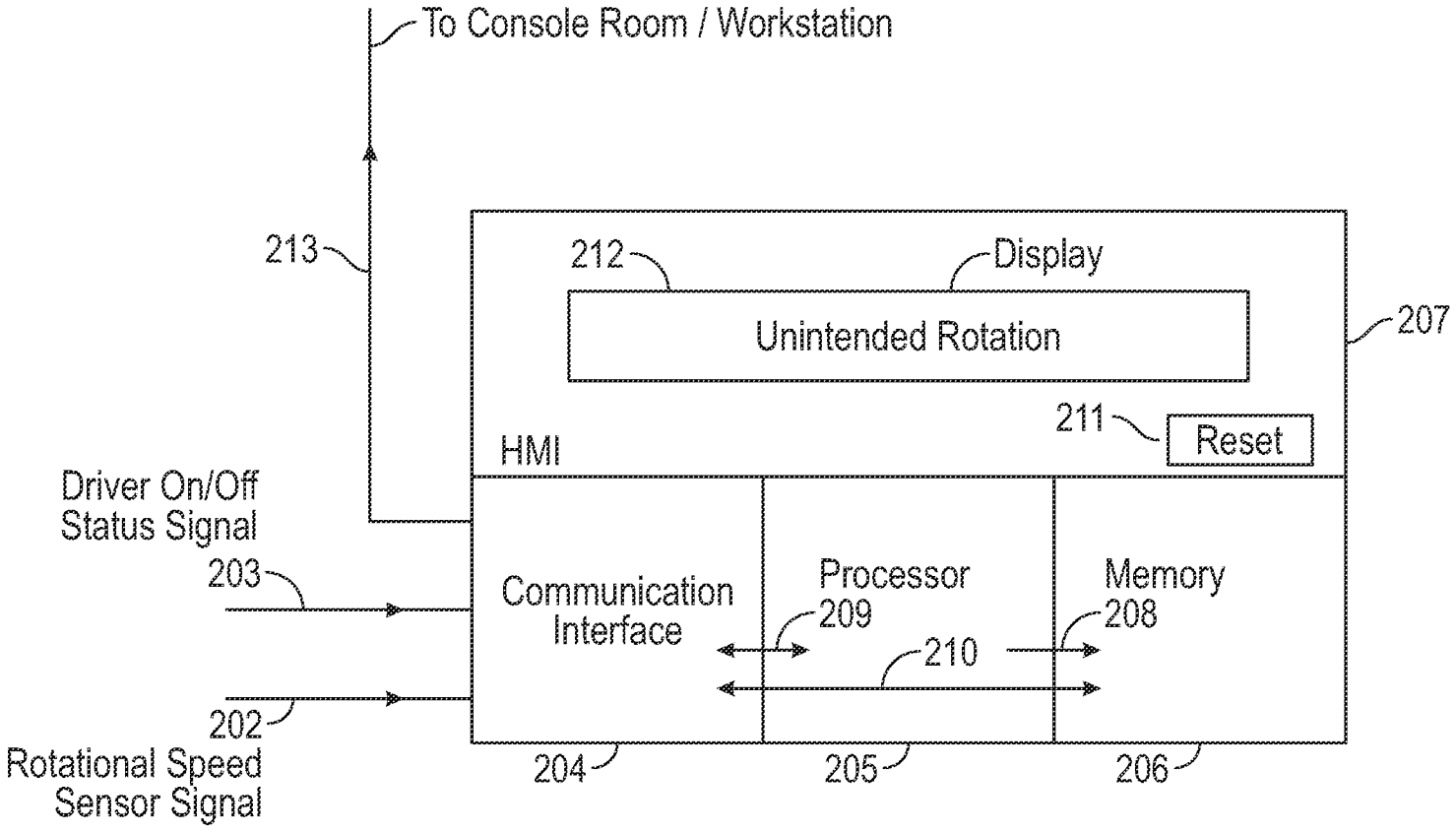
FIG. 2 illustrates a view of a monitoring system coupled to the rotating machinery of FIG. 1 according to one or more embodiments of the present disclosure.

Referring to FIG. 2, in one or more embodiments, the continuous automatized monitoring system (207) may include a processor (205) for implementing methods disclosed herein. The continuous automatized monitoring system (207) may include a human machine interface ("HMI") (211, 212) using a software application and may be provided to aid in the automation of controlling and monitoring the rotating machinery (see 102 in FIG. 1). In one or more embodiments, the HMI (211, 212), such as a control panel, and/or other hardware components may allow an operator to interact through the HMI (211, 212) with the rotating machinery (see 102 in FIG. 1). The HMI (211, 212) may include a screen, such as a touch screen, used as an input (e.g., for a person to input commands) and output (e.g., for display) of the continuous automatized monitoring system (207). In one or more embodiments, the HMI (211, 212) may also include switches, knobs, joysticks and/or other hardware components which may allow an operator to interact through the HMI (211, 212) with the rotating machinery (102).

Still referring to FIG. 2, in one or more embodiments, software architecture according to embodiments of the present disclosure may be implemented in the continuous automatized monitoring system (207) having the HMI (211, 212) built therein or connected thereto. The software architecture may be any combination of mobile, desktop, server, router, switch, embedded device, or other types of hardware may be used. For example, the continuous automatized monitoring system (207) may include one or more computer processors (205), non-persistent storage (e.g., volatile memory, such as random access memory (RAM), cache memory), persistent storage (e.g., a hard disk, an optical drive such as a compact disk (CD) drive or digital versatile disk (DVD) drive, a flash memory, etc.) (206), a communication interface (e.g., Bluetooth interface, infrared interface, network interface, optical interface, etc.) (204), and numerous other elements and functionalities.

Referring to FIG. 2, a computer processor(s) may be an integrated circuit for processing instructions. For example, the computer processor(s) may be one or more cores or micro-cores of a processor. Operational plans according to embodiments of the present disclosure may be executed on a computer processor. The continuous automatized monitoring system (207) may also include one or more input devices, such as a touchscreen, keyboard, mouse, microphone, touchpad, electronic pen, or any other type of input device. Additionally, it is also understood that the continuous automatized monitoring system (207) may receive data from the one or more sensors (see 105, 108 in FIG. 1) described herein as an input.

A communication interface may include an integrated circuit for connecting the computing system to a network (not shown) (e.g., a local area network (LAN), a wide area network (WAN) such as the Internet, mobile network, or any other type of network) and/or to another device, such as another computing device. Further, the continuous automatized monitoring system (207) may include one or more output devices, such as a screen (e.g., a liquid crystal display (LCD), a plasma display, touchscreen, cathode ray tube (CRT) monitor, projector, or other display device), a printer, external storage, or any other output device. One or more of the output devices may be the same or different from the input device(s). The input and output device(s) may be locally or remotely connected to the computer processor(s), non-persistent storage, and persistent storage. Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that, when executed by the processor (205), is configured to perform one or more embodiments of the disclosure. More specifically, the software instructions may correspond to computer readable program code, that when executed by the processor (205) may generate notification signal of unintended rotation.

The above description of functions presents only a few examples of functions performed by the continuous automatized monitoring system (207). Other functions may be performed using one or more embodiments of the disclosure.

Having the continuous automatized monitoring system (207) may significantly improve overall performance of the rotary machinery (see 102 in FIG. 1), site safety, reduced risk of NPT and many other advantages. Embodiments of the present disclosure describe control systems, measurements, and strategies to automating operation. It is further envisioned that continuous automatized monitoring system (207) may locally collect, analyze, and transmit data to a cloud in real-time to provide information, such as equipment health, performance metrics, alerts, and general monitoring, to third parties remotely or through the HMI (211, 212).

In one or more embodiments, commands may be provided on the software application such that operational steps may be displayed on the HMI (212). Operational steps may be a set of instructions to perform multiple processes in the rotary machinery (see 102 in FIG. 1). For example, the instructions may include a sequence to start lubrication system or close the isolation valve HMI (211, 212) may have an emulate mode that can visually show the rotary machinery (see 102 in FIG. 1) to determine current job state and provides choices for possible operation. It is further envisioned that the HMI (211,212) may allow the operator to monitor, change, or shut down operations. For example, the HMI (211, 212) may send permission requests to the operator to perform various instructions. Additionally, the HMI (211, 212) may include visual and sound alerts and to allow for the monitoring and operational detection of the rotary machinery (see 102 in FIG. 1).

According to one or more embodiments of the present disclosure, a general plan suitable for operating the rotary machinery (see 102 in FIG. 1) may be generated into the software application. Thus, a continuous automatized monitoring system may include an outline or overview of modes for rotary machinery operations and an initial set of instructions for how activities within the modes may be performed.

Figure 3:
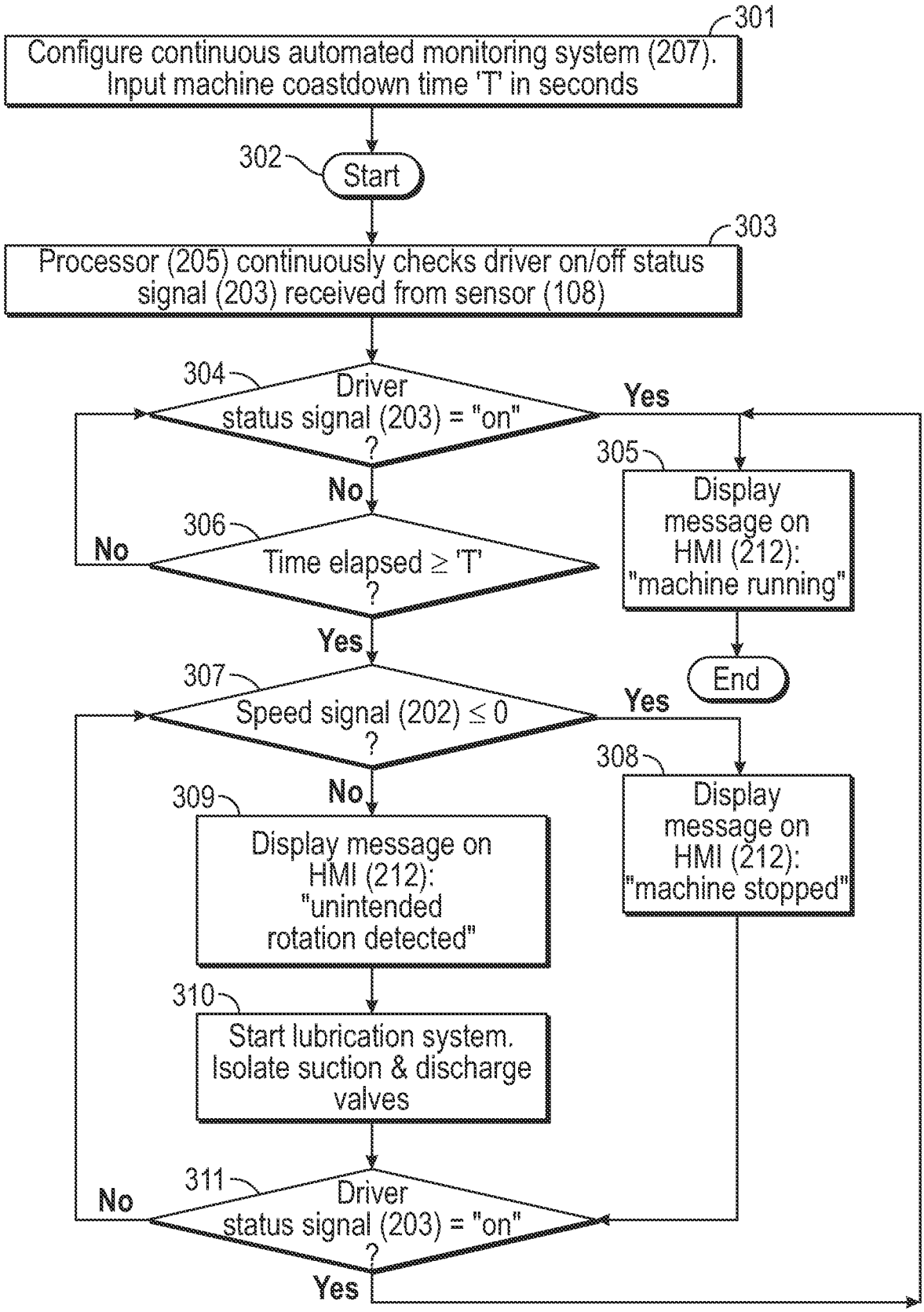
FIG. 3 illustrates a flowchart of automating the rotating machinery of FIG. 1 according to one or more embodiments of the present disclosure.

Referring to FIG. 3, in one or more embodiments, a flowchart is shown of a method implementing the continuous automatized monitoring system (207) on the rotary machinery (102) of FIG. 1. One or more steps in FIG. 3 may be performed by one or more components (e.g., the processor (210) coupled one or more sensors (105, 108) through communication interface (204)) as described in FIGS. 1 and 2. For example, a non-transitory computer readable medium may store instructions on a memory (206) coupled to a processor (205) such that the instructions include functionality for generating the notification signal for the occurrence of unintended rotation of the rotary machinery (102). The system may also include the instructions to include operating lubrication system and isolation valves as described in the step 310 of FIG. 3. While the various steps in FIG. 3 are presented and described sequentially, one of ordinary skill in the art will appreciate that some or all of the blocks may be executed in different orders, may be combined or omitted, and some or all of the steps may be executed in parallel. Furthermore, the steps may be performed actively or passively.

In step 301, the continuous automatized monitoring system (207) is configured manually with the input of coasting down time "T" for the rotary machinery (102) prior to initiating the system for continuous monitoring indicated by step 302. The system starts continuous monitoring of the driver status signal (203) received from the sensor (108) mounted on the driver (103) as indicated by step 303. As shown in step 304, the continuous automatized monitoring system (207) checks the signal (203) status. With the signal (203) returning 'ON' status, the HMI (212) display is configured to indicate "Machine Running" as shown in step 305. With the signal (203) status change to "OFF", the method proceeds to step 306. A timer built in the processor (205) measures the time elapsed from the change in driver status signal (203) from 'ON' to 'OFF'. Upon change in signal (203) status to 'OFF", it is expected that machinery (102) speed decreases gradually to zero revolutions per minute(rpm) prior to elapsing of the coast down time "T" seconds as configured in step 301. Upon elapse of time "T" seconds, the processor (205) initiates checking of the speed signal (202) received from rotating machinery (102) speed sensor (105).

In one or more embodiments, upon elapse of time "T" after the change of status from "ON" to "OFF" as returned by signal (203), if the speed signal (202) returns a value of zero rpm or less (see step 307), the processor is configured to generate notification signal as "Machine Stopped" and the message is displayed on the HMI (212) as shown in step 308. The notification signal is communicated (213) to a console room or workstation (not shown) through communication interface (204) and stored in the memory (208) for record and reference.

However, upon elapse of time "T" after the change of status from "ON" to "OFF" as returned by signal (203), if the speed signal (202) returns a value that is greater than zero rpm (see step 307), the processor (204) is configured to generate notification signal as "Unintended Rotation Detected" and the message is displayed on the HMI (212) as shown in step 309. The system may be configured to initiate additional actions automatically in order to stop the unintended rotation or protect the machinery from damage as shown in step 310.

In one or more embodiments, following the steps 308, 309 and 310, the flowchart proceeds to step 311 wherein the speed signal (202) received from the speed sensor (105) of the rotating machinery (102) is continuously monitored as long as the motor (103) status signal (203) received from the sensor (108) returns "OFF" status. The continuous monitoring is intended to provide automatic and instantaneous detection of the unintended rotation during the entire standby period of the rotating machinery.

In one or more embodiments, in the step 310, the method may further include sending commands to the rotary machinery to start lubrication system and close the suction and discharge isolation valves.

In addition to the benefits described above, the continuous automatized monitoring system may improve an overall efficiency and performance of the rotary machinery while reducing cost. Further, the continuous automatized monitoring system may provide further advantages such as providing continuous monitoring of the rotary machinery, stopping unintended rotation in the rotary machinery without visual inspection, preventing damage to the various components of the rotary machinery and potential loss of contamination through damaged components, provide real-time alerts and notifications on the rotary machinery, automatically initiate preventive measures to avoid equipment damage. It is noted that the continuous automatized monitoring system may be used in a wide variety of processing industries including but not limited to Oil & Gas, Petroleum Refining, Petrochemicals, Fertilizer and Pharmaceutical industries.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method, comprising:

placing, with a controller, a rotary machinery in a standby mode, wherein the standby mode turns off the rotary machinery;

reducing, with the controller, a speed of at least one rotating component of the rotary machinery to zero rotations per minute;

continuously monitoring inputs from sensors on the rotary machinery, wherein the continuously monitoring comprises:

transmitting to the controller a first input from a status indicator sensor based on a mode of the rotary machinery; and transmitting to the controller a second input from a speed sensor based on the speed of the at least one rotating component;

sending, with the controller, alerts to a human machine interface based the first input and the second input.

2. The method of claim 1, wherein if the first input indicates the rotary machinery is in the standby mode and the second input indicates the speed of the at least one rotating component is greater than zero rotations per minute, the method further comprises:

sending a notification to the human machine interface that the at least one rotating component is in unintended rotation; and sending commands to stop a rotation of the at least one rotating component.

3. The method of claim 2, wherein once the rotation of the at least one rotating component stops, the method further comprises:

closing, with the controller, a discharge valve and a suction valve of the rotary machinery; and starting, with the controller, a lubrication cycle to lubricate at least one rotating component bearing of the rotary machinery with lube oil.

4. The method of claim 3, further comprising lubricating at least one rotating component bearings of the motor with lube oil.

5. The method of claim 2, further comprising closing the discharge valve and the suction valve to stop the unintended rotation of the at least one rotating component.

6. The method of claim 1, wherein if the first input indicates the rotary machinery is in a running mode and the second input indicates the speed of the at least one rotating component is greater than zero rotations per minute, the method further comprising:

sending a notification to the human machine interface that the rotary machinery is being operated.

7. The method of claim 1, further comprising displaying the alerts on a screen of the human machine interface.

8. A system, comprising:

a rotary machinery, wherein the rotary machinery comprises:

at least one rotating component;

at least one valve;

a standby mode wherein the at least one rotating component has a rotation speed of zero; and a running mode wherein the at least one rotating component has the rotation speed of great than zero;

one or more sensors disposed on or within the rotary machinery, wherein the one or more sensors are configured to collect data on the rotary machinery, and wherein the collect data includes a first input monitoring a rotation speed of the at least one rotating component and a second input monitoring a mode of the rotary machinery;

a computing system having a controller in communication with the one or more sensors, wherein the computing system is configured to receive the collected data from the one or more sensors; and instructions provided on a software application of the computing system, wherein the instructions comprise a sequence of operations for the controller to send alerts to a human machine interface of the computing system and to send commands to the rotary machinery.

9. The system of claim 8, wherein if the first input indicates the rotary machinery is in the standby mode and the second input indicates the rotation speed is greater than zero rotations per minute, the controller is configured to send an alert to the human machine interface that the at least one rotating component is in unintended rotation.

10. The system of claim 8, wherein the computing system comprises a display for displaying alerts and commands from the controller.

* * * * *